US010799082B2

(12) United States Patent
Leao et al.

(10) Patent No.: US 10,799,082 B2
(45) Date of Patent: Oct. 13, 2020

(54) INFUSED SPRAY MOP

(71) Applicant: Bradshaw International, Inc, Rancho Cucamonga, CA (US)

(72) Inventors: Flavio De Roma Leao, Pearl River, NY (US); Johan Liden, New York, NY (US)

(73) Assignee: Bradshaw International, Inc., Rancho Cucamonga, CA (US)

( * ) Notice: Subject to any disclaimer, the term of this patent is extended or adjusted under 35 U.S.C. 154(b) by 0 days.

(21) Appl. No.: 15/917,610

(22) Filed: Mar. 10, 2018

(65) Prior Publication Data

US 2019/0274514 A1 Sep. 12, 2019

(51) Int. Cl.

| | |
|---|---|
| ***A47L 13/22*** | (2006.01) |
| ***B05B 9/04*** | (2006.01) |
| ***B05B 11/00*** | (2006.01) |

(52) U.S. Cl.

CPC ..... *A47L 13/22* (2013.01); *B05B 9/0426* (2013.01); *B05B 11/0054* (2013.01); *B05B 11/3057* (2013.01)

(58) Field of Classification Search

CPC ..... A47L 13/22; B05B 11/054; B65D 51/28; B65D 51/2857; B65D 51/2864; B65D 51/2892

See application file for complete search history.

(56) References Cited

U.S. PATENT DOCUMENTS

| | | | | |
|---|---|---|---|---|
| 4,088,246 | A * | 5/1978 | Klingaman | B05B 11/0078 222/48 |
| 6,290,100 | B1 * | 9/2001 | Yacko | B05B 11/0081 222/129 |
| 6,960,042 | B1 * | 11/2005 | Hsiao | A47L 13/22 401/138 |
| 6,981,533 | B2 * | 1/2006 | Zorzo | A47L 13/22 141/18 |
| 2011/0158740 | A1 * | 6/2011 | Kandasamy | A47L 13/22 401/270 |

* cited by examiner

*Primary Examiner* — David P Angwin
*Assistant Examiner* — Bradley S Oliver
(74) *Attorney, Agent, or Firm* — Mintz, Levin, Cohn, Ferris, Glovsky and Popeo, P.C.

(57) ABSTRACT

An infused spray mop is disclosed that has a novel cleaning solution arrangement where a dispensing bottle contains a capsule fixture that receives a small infusion capsule filled with a cleaning solution concentrate. The dispensing bottle is filled with water, and through the action of a capsule actuator the infusion capsule releases the concentrate into the water contained in the dispensing bottle, creating a cleaning solution for dispensing and use with the infused spray mop. The infusion capsule of concentrated cleaning solution stores easily, has less waste and cost than one time use containers that attach to a mop, and are not prone to spills and the time consuming process of mixing cleaning solution from a bottle of concentrate and water.

19 Claims, 13 Drawing Sheets

INFUSED SPRAY MOP

FIELD OF THE INVENTION

This invention relates generally to cleaning devices, and more specifically to an infused spray mop.

DESCRIPTION OF RELATED ART

Mops have been used for many years to clean hard surface floors and related surfaces. The cleaning solution is typically located in a bucket and the mop is placed in the bucket for application of the cleaning solution. Use of a bucket for dispensing of cleaning solution is cumbersome and prone to spills and non-hygienic distribution of dirt and particles in the cleaning solution. In recent years, cleaning solution dispensing mops have become popular. These mops contain a bottle of cleaning solution and a dispensing apparatus to deliver the cleaning solution in front of the head of the mop in use. Oftentimes the cleaning solution is purchased already dispensed into a custom bottle for purchase. These bottles are disposable, and represent an ongoing expense as well as a waste stream of disposable bottles and their related packaging. Further, the mop head often contains a disposable cleaning sheet that can be removed and discarded when soiled.

In addition, some of these cleaning solution dispensing mops contain an electric pump to transfer the cleaning solution from a cleaning solution storage bottle to a nozzle that then distributes the cleaning solution on the surface to be cleaned. The use of an electric pump, while convenient, requires the use of batteries that add to the ongoing expense of the cleaning solution dispensing mop and also are not an environmentally responsible approach to cleaning due to the toxic nature of batteries and the associated disposal of them. Further, the use of an electric pump and the associated electrical components required for operation represents another potential point of failure for the mop, especially given exposure to a wet environment and associated cleaning solutions.

The cleaning solution bottles commonly in use can be bulky to store for the consumer, and represent added shipping and storage costs throughout the supply chain. While adding cleaning solution to a reusable bottle on a spray mop is one way to reduce or eliminate the waste associated with a one time use cleaning solution bottle, refilling cleaning solution can be messy, time consuming, and prone to spills or other mishaps. What is needed is a way to refill a cleaning solution bottle of a spray mop that is neat, compact, and cost effective, without the bulk and cost of one time use cleaning solution dispensing bottles.

BRIEF SUMMARY OF THE INVENTION

In accordance with the present invention, there is provided an infused spray mop comprising a mop head and a spray nozzle attached to the mop head for delivery of a cleaning solution, a dispensing bottle in fluid communication with the spray nozzle, a capsule fixture comprising a capsule retainer wherein the capsule fixture is coupled to the dispensing bottle, and a capsule actuator capable of axial travel toward the capsule retainer and axially positioned with the capsule retainer The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
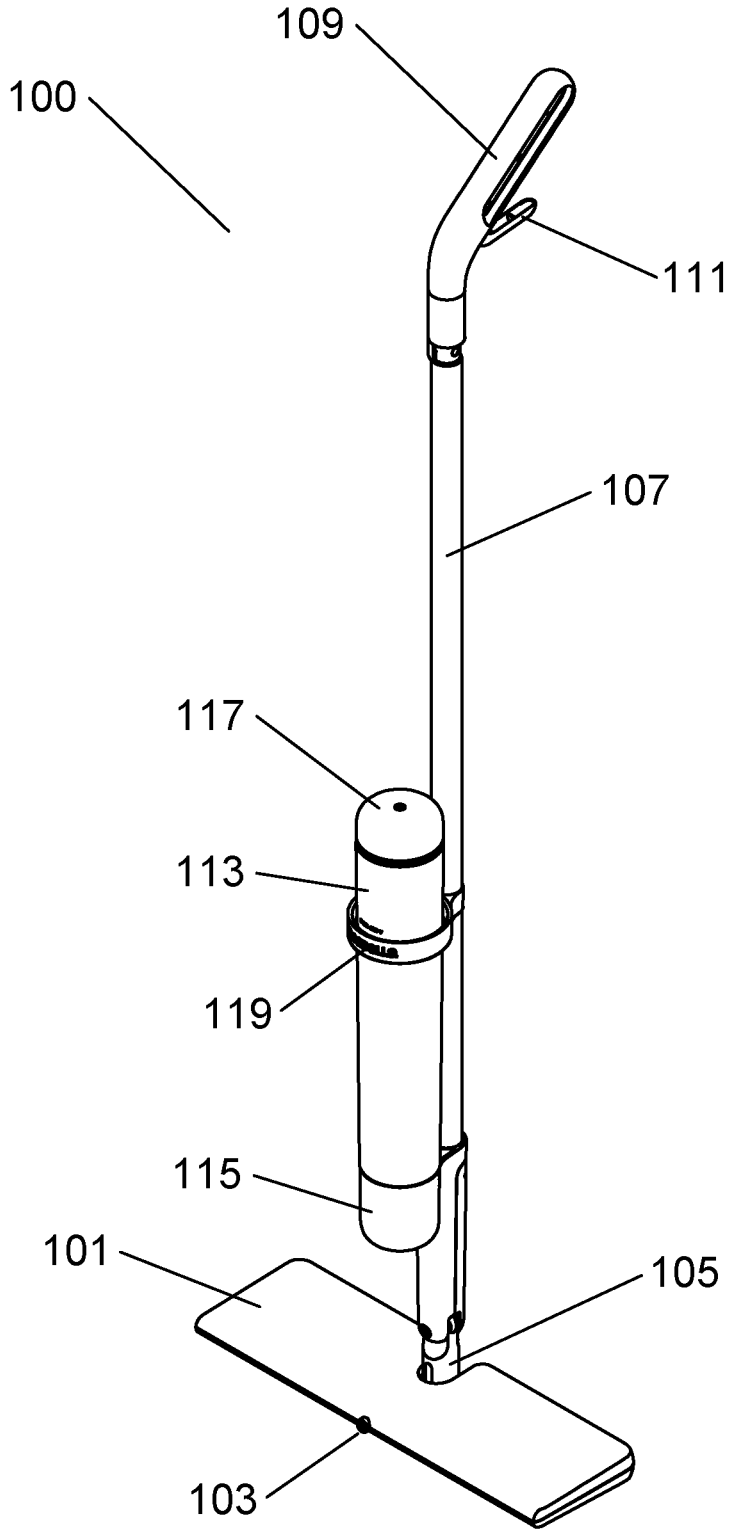
FIG. 1 is a perspective view of the infused spray mop.

The attached figures depict various views of the infused spray mop in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

An infused Spray Mop is described and depicted by way of this specification and the attached drawings. The term spray mop, as used herein, refers to a cleaning device that has the capability to deliver a liquid to aid in the process of cleaning with the device. The term infused refers to the combining of two or more liquids, such as the introduction of one or more liquids into another liquid or liquids.

For a general understanding of the present invention, reference is made to the drawings. In the drawings, like reference numerals have been used throughout to designate identical elements.

Figure 8:
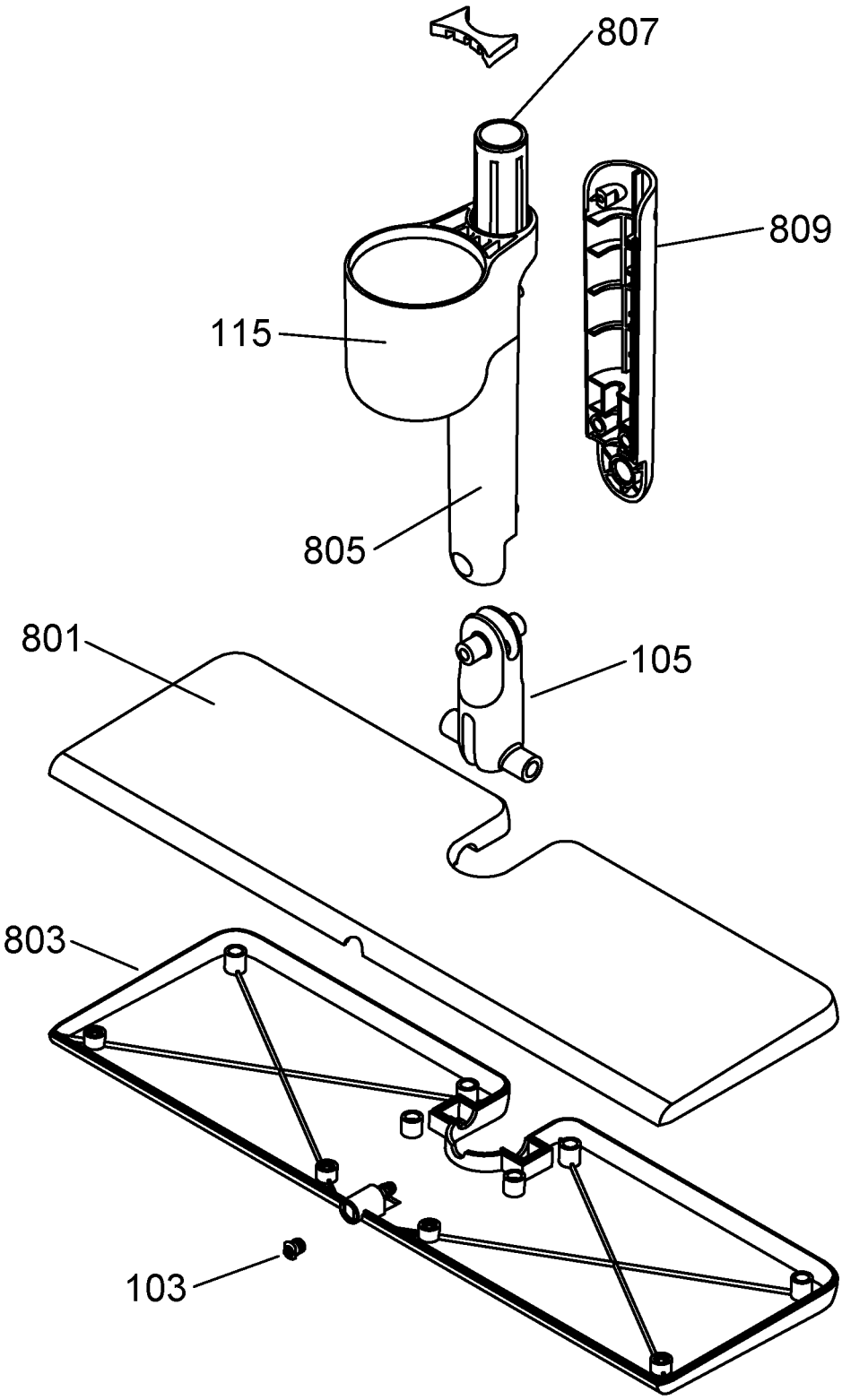
FIG. 8 is an exploded view of the lower section of the infused spray mop.

Referring to FIG. 1, a perspective view of the Infused Spray Mop 100 is shown. Depicted is a mop head 101 comprising an upper half and a lower half. While the mop head 101 may have separate upper half and lower half components that are joined together, in some embodiments of the present invention the mop head 101 is made from a single piece. Such a single piece embodiment, for the purpose of this specification, will still have an upper half and a lower half. The lower half, for example, being the part of the mop head that contacts the floor or surface to be cleaned, either directly, or through the attachment of a cleaning pad, brush, or the like. The mop head 101 is capable of receiving a variety of cleaning surfaces, such as a microfiber pad, a sponge, a brush pad, or the like. Retention devices such as hook and loop fasteners, clips, adhesives, or the like may be employed to retain the cleaning surface to the mop head. A spray nozzle 103 is attached or otherwise formed with the mop head 101 and is in fluid communication with a dispensing bottle 113 and a pump contained within a pump housing 115. The pump is actuated by a trigger 111 or similar device such that dispensing of a cleaning solution contained within the dispensing bottle 113 can be performed by a user of the infused spray mop as required. The mop head 101 is attached to a pole 107 by way of a universal hinge joint 105 that allows for multi-dimensional movement of the mop head 101 during cleaning operations. FIG. 8 depicts the universal hinge joint 105 in further detail along with the constituent components of the mop head 101 and related spray nozzle 103. Tubing between the spray nozzle 103 and dispensing bottle 113 are not shown for clarity. The pole 107 may be made from a metal such as steel, aluminum, or the like. Various plastics, composite materials, or wood may also be used. A handle 109 can also be seen attached to the pole 107 with a curved appearance and a trigger 111 under the handle 109 in a lever type arrangement. The trigger 111 actuates and drives an internal pump within the pump housing 115 either through a mechanical linkage or, in some embodiments of the present invention, the internal pump is driven by an electric motor and the trigger 111 contains an electrical contact such as a switch to turn the electric motor on or off, dispensing cleaning solution through the spray nozzle 103 as required by the user.

Of note in FIG. 1 is a pump housing 115 containing an internal mechanical or electric pump as previously described. The pump housing 115 is attached to or formed with a lower pole section or a pole receiver section and contains an opening such as a cylindrical opening to receive the dispensing bottle 113. Such a cylindrical opening, as will be further depicted in subsequent figures, may contain a larger opening to receive the body of the dispensing bottle 113 and a smaller opening to receive a tapered or narrowed opening of the dispensing bottle 113, similar to that of a beverage bottle. This smaller opening delivers cleaning solution from the dispensing bottle 113 into the internal pump in the pump housing 115. A cap 117 can also be seen in FIG. 1. This cap 117 not only seals the dispensing bottle 113, but the cap 117 also provides access to an infusion capsule arrangement where an infusion capsule that contains concentrated cleaning solution is placed in the dispensing bottle 113 which has been filled with water, and the action of the cap 117 in combination with a capsule actuator causes the release of the concentrated cleaning solution into the water of the dispensing bottle 113, creating a cleaning solution to be utilized during cleaning with the infused spray mop of the present invention. The infusion capsule releases the concentrated cleaning solution by way of a puncture, a tear, removal of a component of the capsule, or the like. Described herein by way of example, and not limitation, is an infusion capsule where the bottom separates to release the concentrated cleaning solution. An outer retainer ring 119 can also be seen that holds the upper portion of the dispensing bottle 113 to the pole 107, creating stability to the dispensing bottle 113 during use.

The various components of the infused spray mop 100 may be made from materials such as plastics, metals, composites, wood, or the like. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. The various components of the infused spray mop 100 may be made by injection molding, blow molding, machining, or the like.

Figure 2:
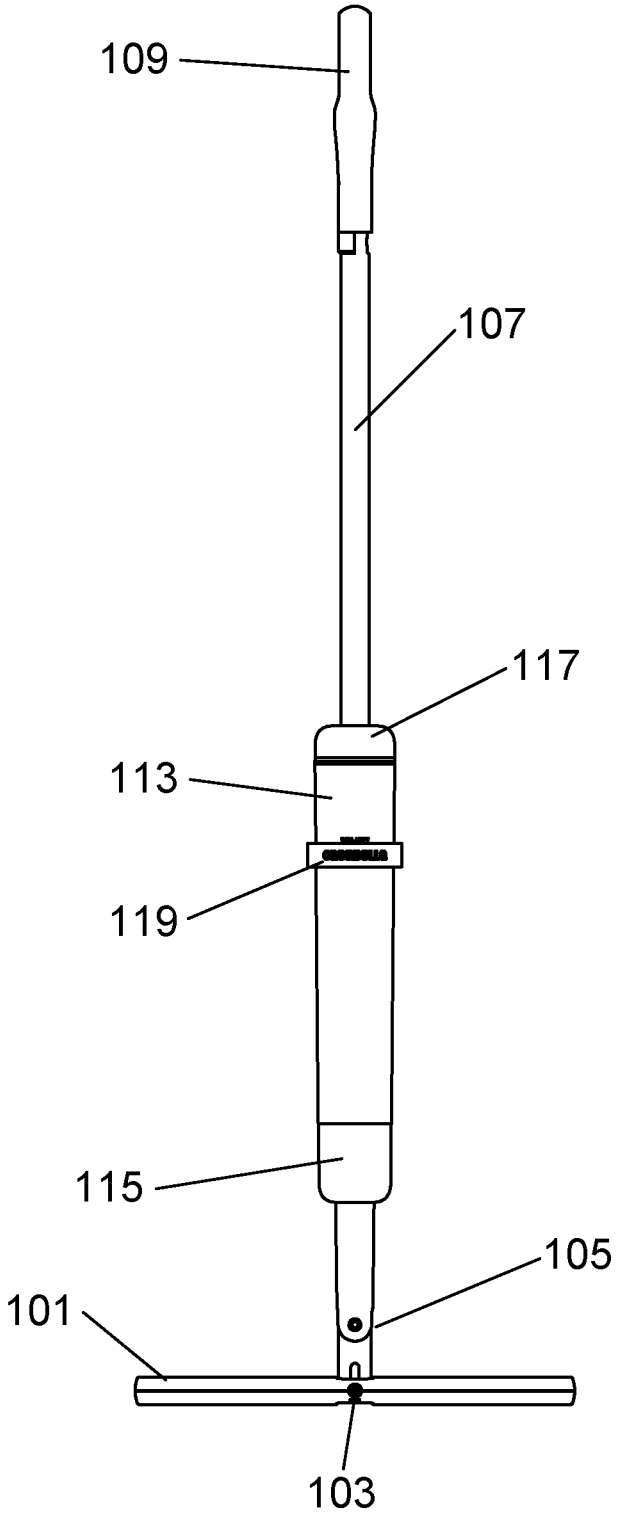
FIG. 2 is a front plan view of the infused spray mop.

FIG. 2 is a front plan view of the infused spray mop. The dispensing bottle 113 can be seen as a long cylindrical form with the cap 117 affixed to the upper portion and the pump housing 115 retaining the lower portion. The outer retaining ring 119 can also be seen.

Figure 3:
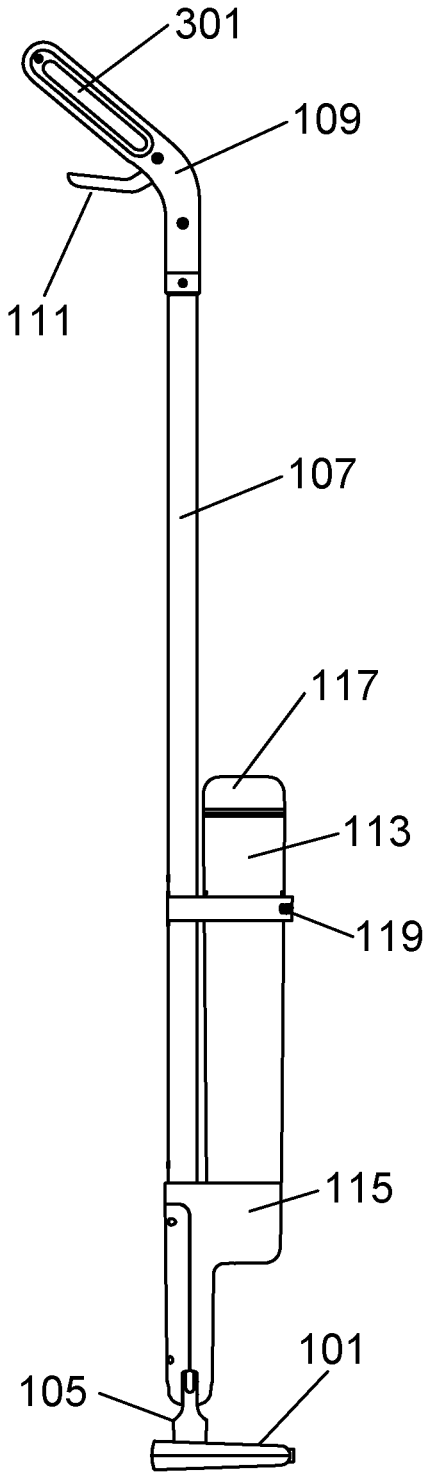
FIG. 3 is a side plan view of the infused spray mop.
Figure 4:
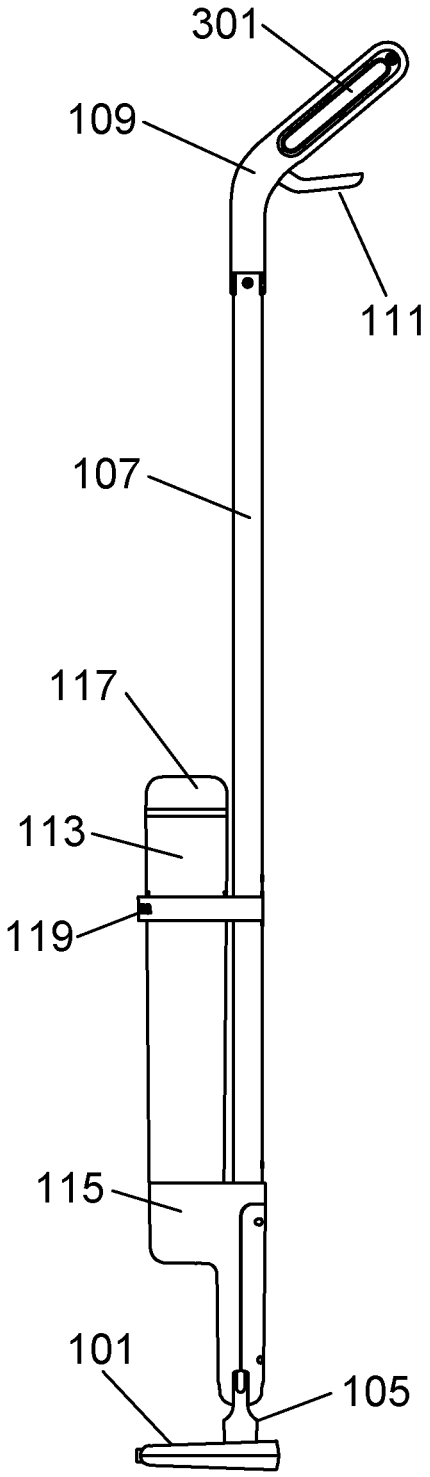
FIG. 4 is an alternate side plan view of the infused spray mop.

FIG. 3 is a side plan view of the infused spray mop. The handle 109 can be seen angled with the pole 107. A handle opening 301 can also be seen as an opening through the handle 109. In the example depicted by way of FIG. 3, the handle opening 301 is generally oval or slotted. FIG. 4 is an alternate side plan view of the infused spray mop. The two sides depicted by way of FIGS. 3 and 4 are substantially symmetrical.

Figure 5:
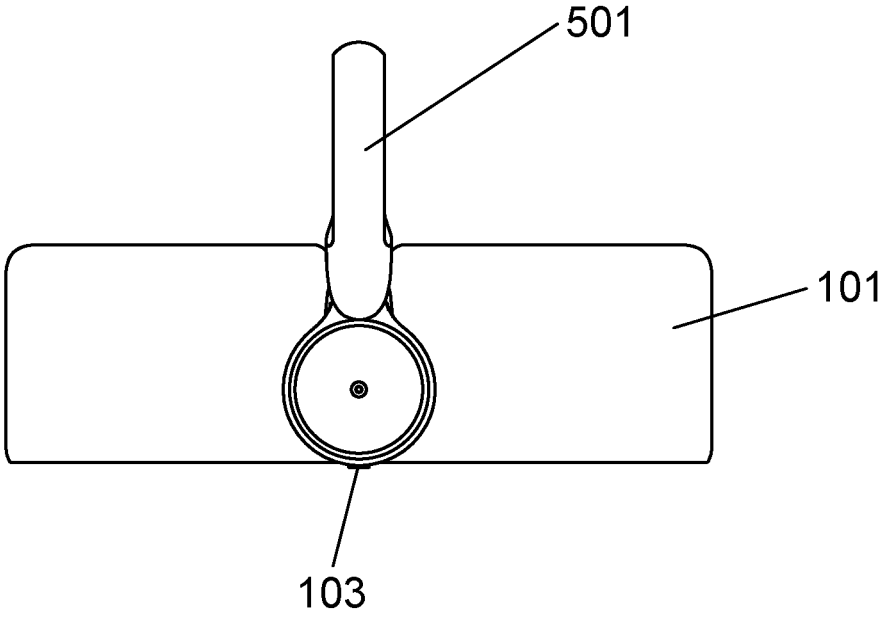
FIG. 5 is a top plan view of the mop head of the infused spray mop.
Figure 6:
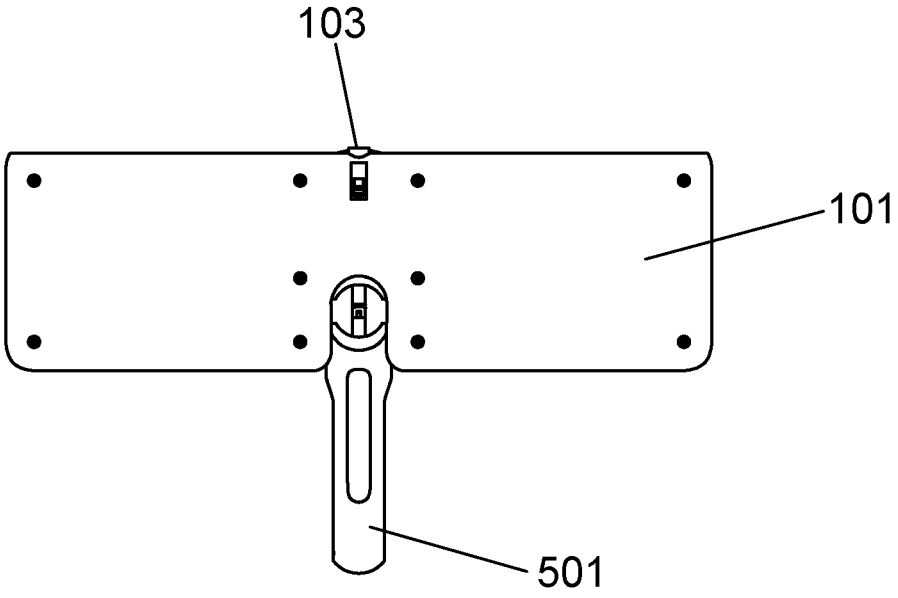
FIG. 6 is a bottom plan view of the mop head of the infused spray mop.

FIG. 5 is a top plan view of the mop head of the infused spray mop. A pole receiver 501 can be seen that allows the universal hinge joint and attached mop head to be attached to the pole 107, as seen in FIG. 1. FIG. 6 is a bottom plan view of the mop head of the infused spray mop showing further detail of the pole receiver 501.

Figure 7:
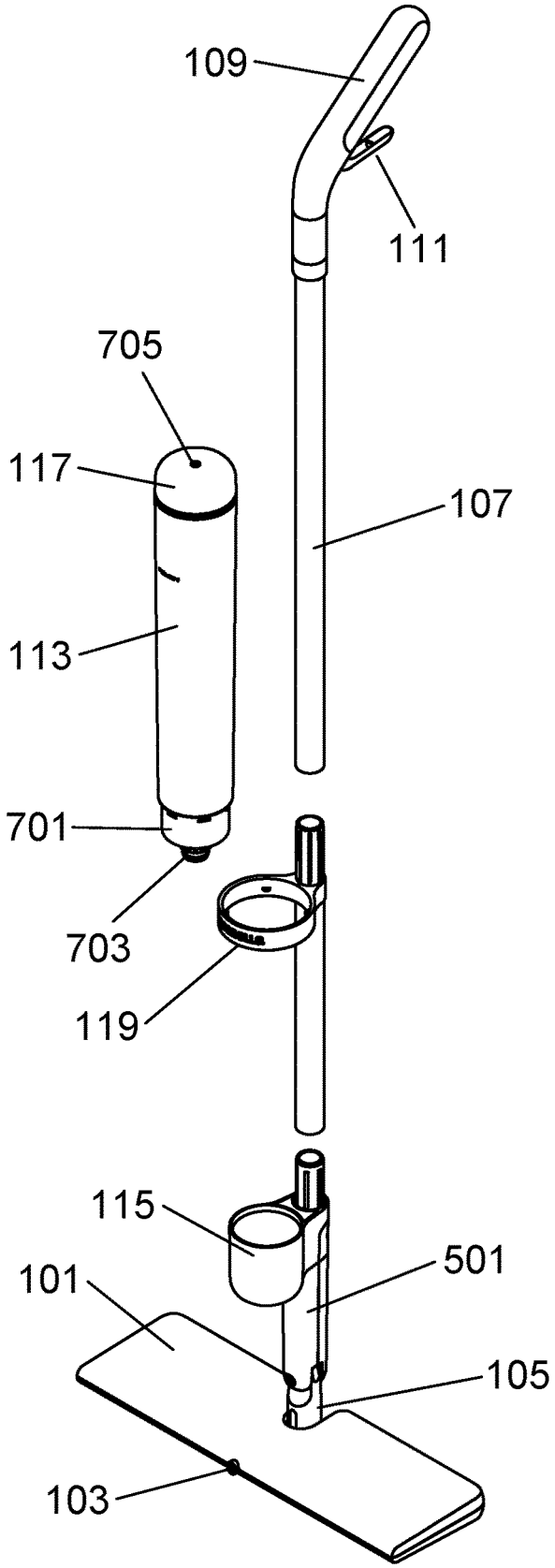
FIG. 7 is an exploded view of the infused spray mop.
Figure 16:
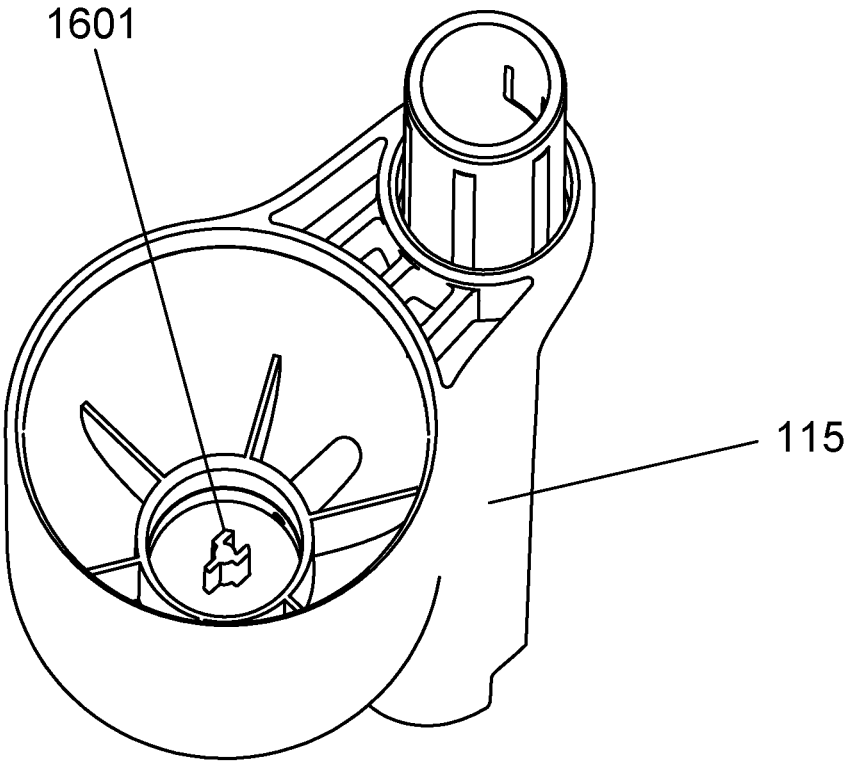
FIG. 16 is a perspective view of the pump housing.

FIG. 7 is an exploded view of the infused spray mop showing how the dispensing bottle 113 is formed with an upper fitting 701 and a lower fitting 703. The upper fitting 701 is a reduction in the diameter of the dispensing bottle 113 such that it fits securely into the pump housing 115. The lower fitting 703 is a further reduction in the diameter of the dispensing bottle 113 such that the lower fitting 703 engages with a receiver within the pump housing 115, as seen in FIG. 16. The receiver is a cylindrical structure that may further contain inner threads or other such structure to retain the dispensing bottle 113 and create a liquid tight seal. O-rings, gaskets, or other such sealing devices may also be employed to ensure a liquid tight seal. In some embodiments of the present invention, the lower fitting 703 contains further seals and valves, and is press fit into the receiver of the pump housing, creating a liquid tight and easily removable seal.

FIG. 8 is an exploded view of the lower section of the infused spray mop. The upper half of the mop head 801 and the lower half of the mop head 803 can be seen along with fastener features for joining the halves together. The spray nozzle 103 can be seen between the two halves. Not shown is tubing such as plastic tubing to fluidically connect the spray nozzle 103 with the dispensing bottle and internal pump. A pole receiver joint section first half 805 can be seen along with a pole receiver joint section second half 809. The two halves are joined together, and further comprise a pole receiver insert section 807 that extends outward for mating with a pole such as a hollow steel or aluminum pole. The insert section 807 may also have ribs or ridges to provided added strength and joining capabilities. The pump housing 115 can also be seen joined with the pole receiver. The pump housing may be cylindrical where the axis of the generally cylindrical form of the pump housing is generally parallel with the axis of the pole receiver and pole of the infused spray mop. The pole receiver joint section has a rounded end with a hole for attachment to the universal hinge joint 105 by a pin or the like.

Figure 9:
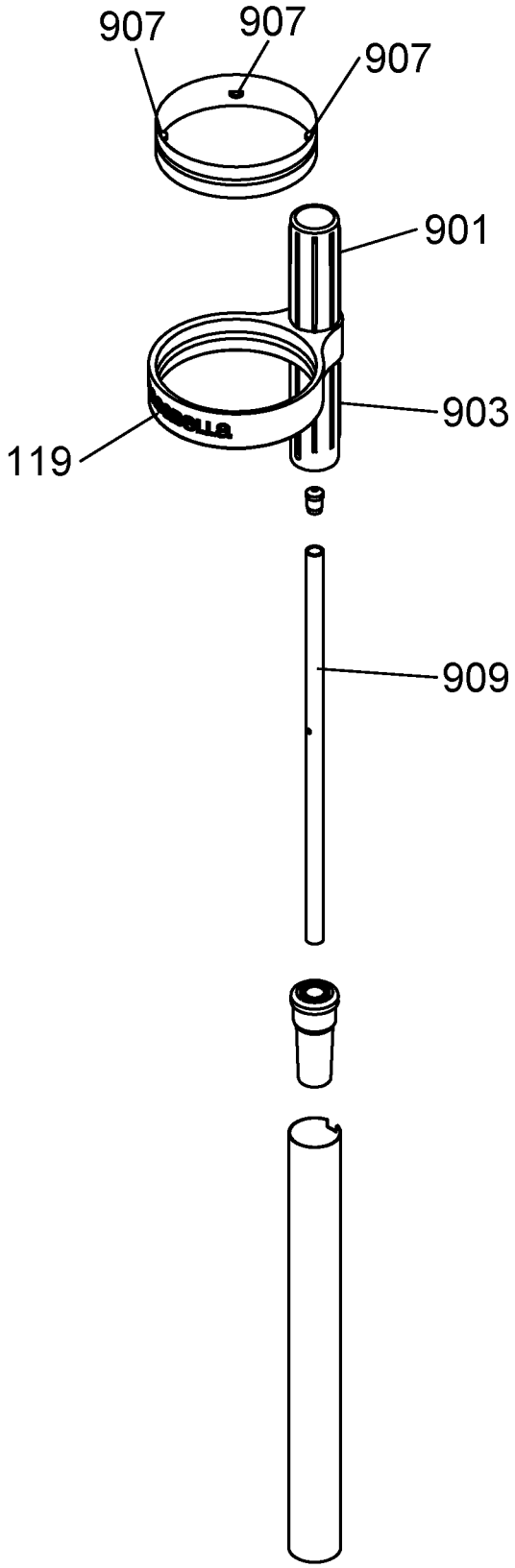
FIG. 9 is an exploded view of the mid section of the infused spray mop.

Turning now to FIG. 9, an exploded view of the mid section of the infused spray mop can be seen. A first coupler 901 and a second coupler 903 serve to join two sections of the pole together and also are joined with the outer retainer ring 119. The first coupler 901 and the second coupler 903 may also have ribs or ridges to provided added strength and joining capabilities. A lower tube section 909 can be seen within a section of the hollow pole for linking the trigger to the internal pump and subsequent spray nozzle 103. The outer retainer ring 119 can be seen along with an inner retainer ring having standoffs 907 for contact with and retention of the dispensing bottle 113 (see FIG. 1). In addition to providing secure retention of the dispensing bottle, the standoffs 907 also provide a unique look to the dispensing bottle and retainer ring arrangement. In some embodiments of the present invention the dispensing bottle is clear and the standoffs create the appearance that the dispensing bottle is suspended or floating within the retainer ring, providing both utility as well as aesthetically pleasing ornamentation.

Figure 10:
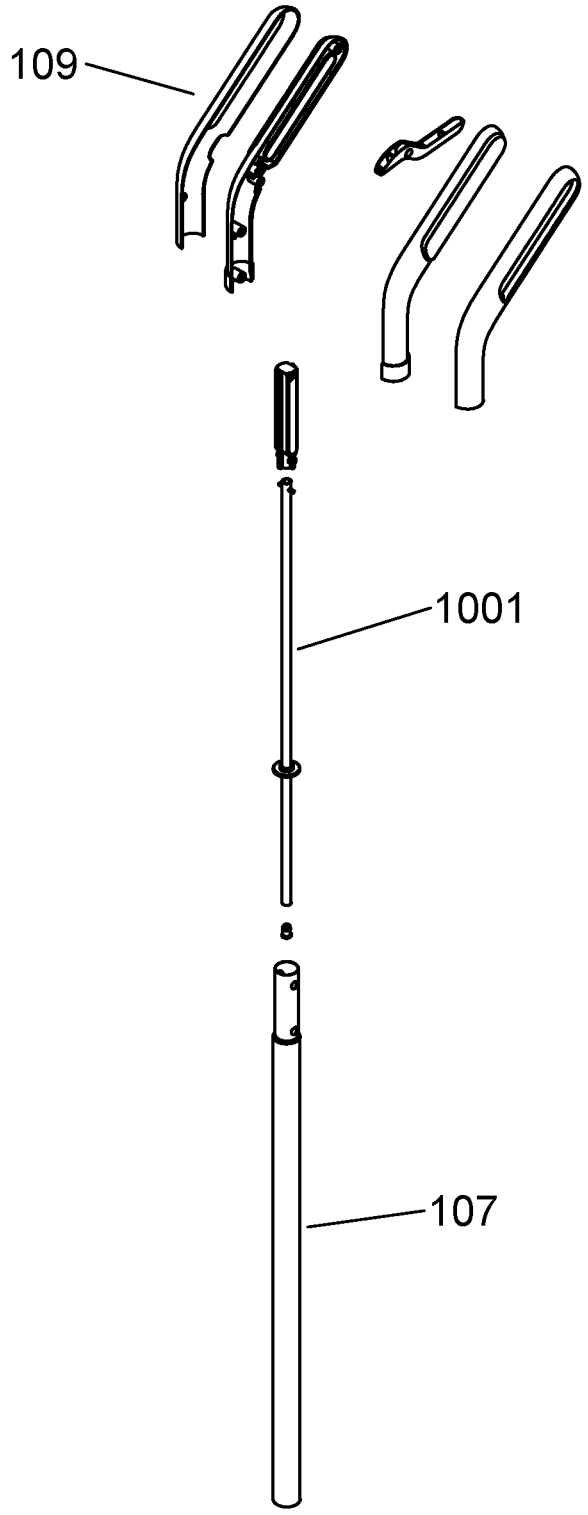
FIG. 10 is an exploded view of the upper section of the infused spray mop.

FIG. 10 is an exploded view of the upper section of the infused spray mop. In the upper section depicted, an upper tube section 1001 can be seen within the pole 107. The upper tube section 1001 links the trigger assembly of the handle 109 with the lower tube section and internal pump. Further, the trigger and handle 109 can be seen where the handle 109 has an angle and the trigger is located below the handle at an activation angle. Once the trigger is activated, the trigger becomes generally parallel with the handle, or may, with partial flow or partial activation, be at a slightly offset angle in relation to the handle 109.

Figure 11:
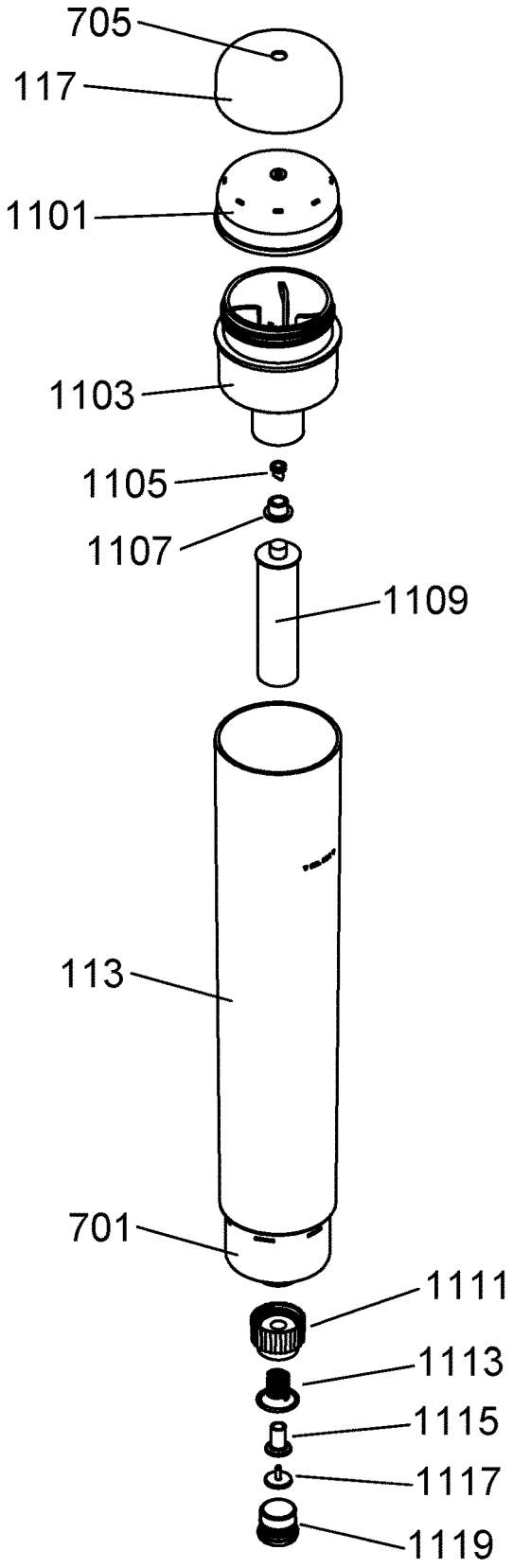
FIG. 11 is an exploded view of the dispensing bottle assembly.

FIG. 11 is an exploded view of the dispensing bottle assembly, clearly depicting the novel infusion capsule assembly for releasing a capsule of cleaning solution concentrate into a dispensing bottle of water to create a self-contained cleaning solution for use in the infused spray mop of the present invention. A cap 117 can be seen that is capable of removably closing the dispensing bottle 113. In some embodiments of the present invention, the cap 117 has an inner cap 1101 that is threaded and mates with the capsule fixture 1103. The inner cap 1101 may be covered with a soft durometer material to form the cap 117. The capsule fixture 1103 is cylindrically disposed within the dispensing bottle and has a capsule retainer (see 1503 of FIG. 15). The capsule retainer is in turn cylindrically disposed within the capsule fixture 1103 and serves to accommodate and retain an infusion capsule 1109 that contains concentrated cleaning solution. The cap 117 or the inner cap 1101 have a capsule actuator 1107 affixed to the underside of the cap 117 or the inner cap 1101. A valve or vent 1105 can also be seen that allows for the one way movement of air from the dispensing bottle 113 as cleaning solution is used up. The capsule actuator 1107 may be cylindrical, and may also have an air release opening that is connected to the valve 1105. The capsule actuator 1107, whether cylindrical or another geometry, must be of sufficient size to engage with and push down upon a capsule push rod 1205 (see FIG. 12) to in turn release the cleaning to solution concentrate from the infusion capsule 1109. The capsule actuator 1107 engages with and pushes down on the capsule push rod 1205 depicted in FIG. 12 when the cap 117 is screwed downward onto the capsule fixture 1103 that is in turn seated or housed within the dispensing bottle 113. The capsule actuator 1107 is capable of axial travel toward the capsule retainer 1503 (see FIG. 15) where the capsule retainer 1503 is cylindrical with an axis defined therein. Axial travel of the capsule actuator 1107 is accomplished by screwing down on the cap 117, pushing down on the cap 117, or otherwise imparting linear motion to the capsule actuator 1107 that causes the capsule actuator 1107 to travel inward along the axis of the capsule retainer 1503. As will be seen and described by way of FIGS. 12 and 13, the axial displacement of the capsule actuator 1107 pushes down on the capsule push rod 1205, which is connected to the capsule bottom 1207, causing the capsule bottom 1207 to break from the capsule cylinder 1201, releasing the contents of the capsule 1109 into the dispensing bottle 113 that has been filled with water.

The dispensing bottle 113 is also removably and fluidically connected with the pump housing 115 and internal pump. While the upper fitting 701 is a reduction in the diameter of the dispensing bottle 113 such that it fits securely into the pump housing 115, the lower fitting 703 (not clearly seen in FIG. 11, see FIG. 7) is a further reduction in the diameter of the dispensing bottle 113 such that the lower fitting 703 engages with a receiver within the pump housing 115, as seen in FIG. 16. The receiver is a cylindrical structure that may further contain inner threads or other such structure to retain the dispensing bottle 113 and create a liquid tight seal. O-rings, gaskets, or other such sealing devices may also be employed to ensure a liquid tight seal. In some embodiments of the present invention, the to lower fitting 703 contains further seals and valves, and is press fit into the receiver of the pump housing, creating a liquid tight and easily removable seal. For example, a screw on cap 111 can be seen that contains a valve stem 115 and a valve 1117 with a spring 113 and a sealing cap 1119. The valve may be made from a silicone or other soft durometer material, deforming and allowing fluid to flow from the dispensing bottle 113 with a change in pressure resulting from actuation of the internal pump. Such an arrangement allows cleaning solution to exit the dispensing bottle 113 toward the spray nozzle 103 only upon movement of the trigger and subsequent activation of the internal pump.

Figure 12:
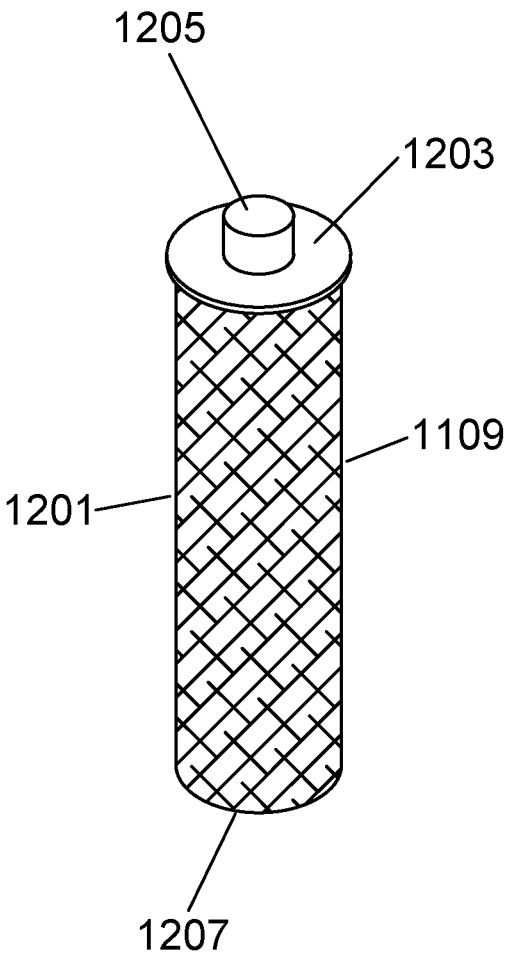
FIG. 12 is a perspective view of a full capsule.
Figure 13:
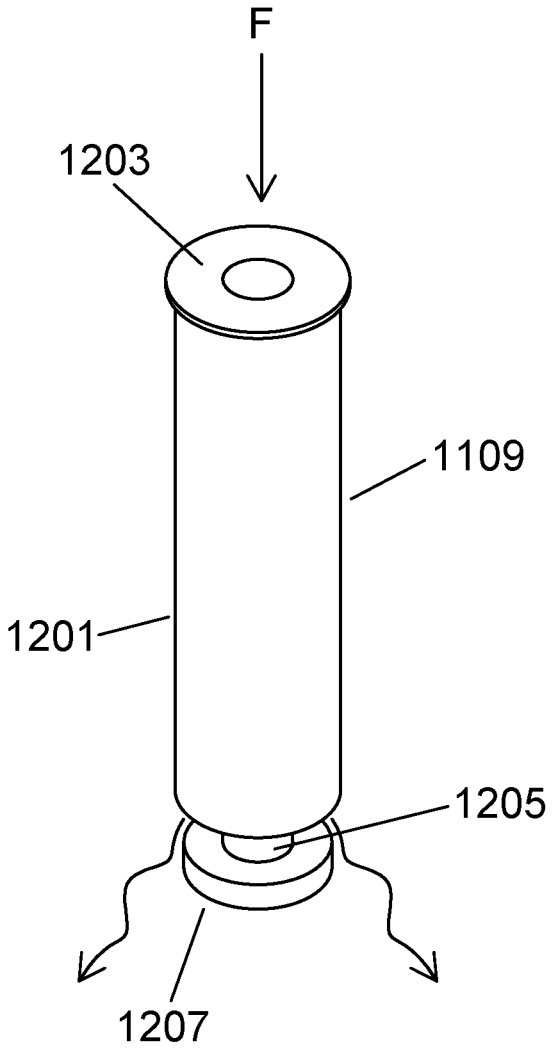
FIG. 13 is a perspective view of a capsule in a release state.
Figure 14:
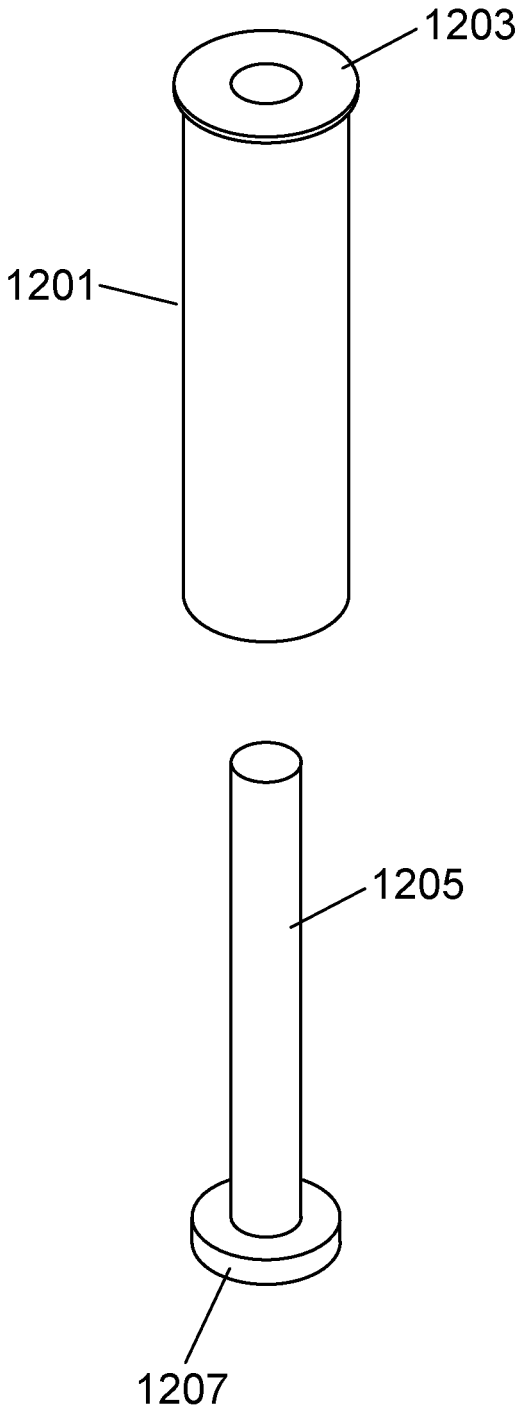
FIG. 14 is an exploded view of an infusion capsule.

FIGS. 12, 13 and 14 depict the infusion capsule 1109 in various states. FIG. 12 is a perspective view of an infusion capsule 1109 containing concentrated cleaning solution. The infusion capsule comprises a capsule cylinder 1201 a capsule bottom 1207 releasably affixed to the capsule cylinder 1201, a capsule push rod 1205 mechanically coupled to the capsule bottom 1207, and a capsule top 1203 where the capsule push rod 1205 is concentrically disposed through the capsule top 1203. A seal between the capsule push rod 1205 and the capsule top 1203 may also be present. The capsule bottom 1207 may be joined to the capsule cylinder 1201 with an adhesive such that a known force is required to push the capsule bottom 1207 away from the capsule cylinder 1201 to release the cleaning solution concentrate from the infusion capsule 1109. FIG. 13 is a perspective view of an infusion capsule 1109 in a release state where a force F has been applied to the capsule push rod 1205, pushing the capsule push rod 1205 downward and creating downward force onto the capsule bottom 1207, causing the capsule bottom 1207 to break away from the capsule cylinder 1201, causing the cleaning solution concentrate within the infusion capsule 1109 to be released.

FIG. 14 is an exploded view of an infusion capsule showing the capsule cylinder 1201, the capsule top with a hole for receiving the capsule push rod 1205 and the capsule bottom 1207 affixed to the capsule push rod 1205. It should be noted that in some embodiments of the present invention, the capsule top 1203 has a larger diameter than the capsule cylinder 1201 to retain the infusion capsule 1109 in the capsule retainer 1503 without moving axially inward when the capsule actuator 1107 travels axially inward to engage with the capsule push rod 1205.

Figure 15:
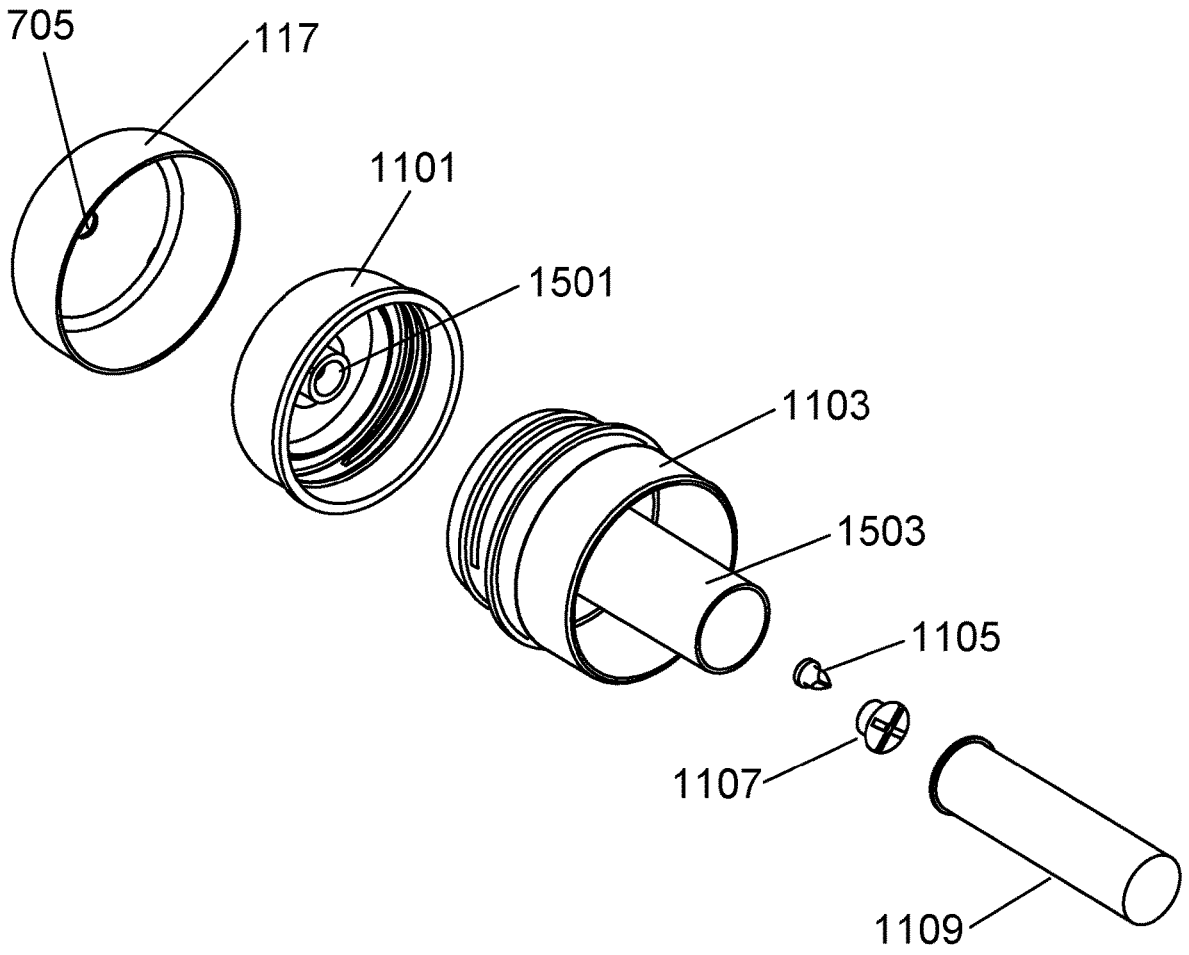
FIG. 15 is an exploded view of the infusion assembly.

FIG. 15 is an exploded view of the infusion assembly showing the capsule fixture 1103 with the capsule retainer 1503 cylindrically disposed within the capsule fixture 1103. The inner cap 1101 has an actuator body 1501 that may further retain a capsule actuator 1107. In some embodiments of the present invention, the capsule actuator 1107 has a hole or similar opening to allow the passage of air from the dispensing bottle through the vent 705 of the cap 117. A valve 1105 may also be employed to allow for the one way passage of air.

Lastly, FIG. 16 is a perspective view of the pump housing 115 showing the generally cylindrical shape of the pump housing 115 and the inner retainer for receiving the lower fitting 703 of the dispensing bottle 113 and the cylindrical opening for receiving the upper fitting 701 of the dispensing bottle. A fluid standoff 1601 can be seen that allows for the passage of cleaning solution from the dispensing bottle 113 to the internal pump and then the spray nozzle.

To use the infused spray mop, the cap 117 is removed from the dispensing bottle 113, and the dispensing bottle is filled with water. In some embodiments of the present invention, the cap 117 will remove with the capsule fixture 1103. The cap 117 is then separated from the capsule fixture 1103 if it is not already separated. An infusion capsule 1109 is then placed into the capsule retainer 1503 of the capsule fixture 1103 with the bottom of the infusion capsule 1109 being placed through the top of the capsule retainer (the top being the portion of the capsule retainer that is threaded or otherwise fixtured to receive the cap 117). In this way the top of the infusion capsule is able to engage with the capsule actuator 1107 affixed to the underside of the cap 117. The capsule fixture 1103 is then placed into the upper portion of the dispensing bottle 113 if it is not there already. The cap 117 is then placed onto the capsule fixture 1103 and tightened down (if equipped with threads, the cap 117 is threaded down onto the capsule fixture 1103). Once the cap 117 has been tightened onto the capsule fixture 1103 completely, the capsule bottom 1207 will have released from the capsule cylinder, releasing the concentrated cleaning solution of the infusion capsule into the water of the dispensing bottle, creating a cleaning solution for use during mopping and cleaning operations. The cleaning solution can then be dispensed as needed by the user with a pull of the trigger 111. When the cleaning solution has been entirely used, the empty infusion capsule can be removed and more cleaning solution can be made with a new infusion capsule and water.

It is, therefore, apparent that there has been provided, in accordance with the various objects of the present invention, an infused spray mop. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. An infused spray mop comprising:

a mop head comprising an upper half, a lower half, and a spray nozzle attached to the mop head for delivery of a cleaning solution;

a dispensing bottle in fluid communication with the spray nozzle;

a capsule fixture comprising threads and a cylindrical capsule retainer capable of coaxially receiving a capsule; wherein the capsule fixture is slideably coupled to the dispensing bottle; and wherein the capsule fixture has a diameter greater than the diameter of the cylindrical capsule retainer;

a capsule actuator configured to be axially positioned with the capsule retainer;

an inner cap comprising a vent and threads that mate with the threads of the capsule fixture;

wherein the capsule actuator protrudes outward from, and is axially concentric with, the inner cap and is capable of axial travel toward but not through the capsule retainer when the inner cap is threaded onto the capsule fixture.

2. The infused spray mop of claim 1, further comprising a cap capable of removably closing the dispensing bottle.

3. The infused spray mop of claim 2, wherein the capsule actuator is affixed to the underside of the cap.

4. The infused spray mop of claim 3, wherein the cap further comprises threads configured to engage with the dispensing bottle and cause axial displacement of the capsule actuator when engaged with the dispensing bottle.

5. The infused spray mop of claim 1, further comprising a pump housing containing a pump for delivering fluid contained in the dispensing bottle through the spray nozzle.

6. The infused spray mop of claim 5, further comprising a sealing cap and a valve between the dispensing bottle and the pump housing.

7. The infused spray mop of claim 1, wherein the capsule retainer is cylindrically disposed with the capsule fixture.

8. The infused spray mop of claim 7, wherein the capsule fixture is cylindrically disposed within the dispensing bottle.

9. The infused spray mop of claim 1, further comprising a sealing cap having a valve and engaged with the dispensing bottle.

10. The infused spray mop of claim 1, further comprising a capsule for releasably holding a concentrated cleaning solution.

11. The infused spray mop of claim 10, wherein the capsule is configured to be retained by the capsule retainer.

12. The infused spray mop of claim 11, wherein the capsule is cylindrical.

13. A cleaning kit comprising:

the infused spray mop of claim 1; and a concentrated cleaning solution contained in a capsule.

14. An infused spray mop comprising:

a mop head comprising an upper half, a lower half, and a spray nozzle attached to the mop head for delivery of a cleaning solution;

a dispensing bottle in fluid communication with the spray nozzle;

a cap comprising a vent and capable of removably closing the dispensing bottle;

a capsule fixture comprising threads and a cylindrical capsule retainer capable of coaxially receiving a capsule; wherein the capsule fixture is slideably coupled to the dispensing bottle; and wherein the capsule fixture has a diameter greater than the diameter of the cylindrical capsule retainer;

a capsule actuator configured to be axially positioned with the capsule retainer and protruding outward from, and axially concentric with, the underside of the cap;

the cap having threads that mate with the threads of the capsule fixture;

wherein the capsule actuator is capable of axial travel toward but not through the capsule retainer when the cap is threaded onto the capsule fixture;

a pole with a universal hinge joint coupled to the mop head;

a retainer ring holding the dispensing bottle to the pole; and a pump housing containing a pump for delivering fluid contained in the dispensing bottle through the spray nozzle.

15. The infused spray mop of claim 14, further comprising a handle with a trigger attached to the pole.

16. The infused spray mop of claim 15, wherein the trigger is mechanically coupled to the pump within the pump housing.

17. The infused spray mop of claim 14, wherein the pump housing retains the dispensing bottle.

18. The infused spray mop of claim 14, wherein the retainer ring comprises inner standoffs for contact with the dispensing bottle.

19. The infused spray mop of claim 14, further comprising a capsule for releasably holding a cleaning solution.

* * * * *